US006352420B1

(12) United States Patent
Shen et al.

(10) Patent No.: US 6,352,420 B1
(45) Date of Patent: Mar. 5, 2002

(54) COMPLEX TEETH-TYPE GAS COMPRESSOR

(75) Inventors: Jinfeng Shen; Rongfu Liu; Jicheng Liu; Jun Wang, all of Mianyang (CN)

(73) Assignee: Osen Science & Technology Co., Ltd., Mianyang (CN)

( * ) Notice: Subject to any disclaimer, the term of this patent is extended or adjusted under 35 U.S.C. 154(b) by 0 days.

(21) Appl. No.: 09/623,644

(22) PCT Filed: Dec. 31, 1998

(86) PCT No.: PCT/CN98/00322

§ 371 Date: Nov. 8, 2000

§ 102(e) Date: Nov. 8, 2000

(87) PCT Pub. No.: WO99/46507

PCT Pub. Date: Sep. 16, 1999

(30) Foreign Application Priority Data

Mar. 11, 1998 (CN) ..... 98111890 A

(51) Int. Cl.[7] ..... F04C 18/20; F04C 23/00

(52) U.S. Cl. ..... 418/183; 418/191; 418/196

(58) Field of Search ..... 418/183, 191, 418/196

(56) References Cited

U.S. PATENT DOCUMENTS 40,660 A * 11/1863 Knapp ..... 418/191
3,574,490 A * 4/1971 Hartmann ..... 418/196
3,574,491 A 4/1971 Martin ..... 418/205

FOREIGN PATENT DOCUMENTS

| | | |
|---|---|---|
| CN | 1036290 | 10/1997 |
| DE | 3324485 | 1/1985 |
| EP | 0432287 | 6/1991 |
| WO | 9102888 | 3/1991 |

* cited by examiner

*Primary Examiner*—John J. Vrablik
(74) *Attorney, Agent, or Firm*—Ladas & Parry

(57) ABSTRACT

A compound teeth type gas compressor comprises a housing with an upper end cover and a lower end cover mounted on both sides of the housing for constituting a seal cavity, a pair of meshing gears rotatably accommodated in the cavity, each gear having two kinds of teeth which are of different size and have a common pitch circle, an inlet port and an outlet port, an intake chamber and a discharge chamber positioned respectively on the sides of the inlet port and the outlet port in the cavity, characterized in fact that the gears are unidirectionally rotated, one of them is a driving gear having larger teeth, the other is a driven gear having larger gullets engaged with the larger teeth, the larger teeth and the larger gullets are formed with asymmetric shapes, and, as viewed in the rotation directions of the gears, their front flank profile curves are designed to achieve a transmission of a constant angular velocity ratio while their rear flank profile curves are designed to be in conjugate contact with each other from the beginning to the end of touching.

3 Claims, 11 Drawing Sheets

COMPLEX TEETH-TYPE GAS COMPRESSOR

FIELD OF THE INVENTION

The present invention relates to a compound teeth type gas compressor.

BACKGROUND OF THE INVENTION

U.S. Pat. No. 3,574,491 discloses a compound teeth type rotary machine for transport of liquids or for compression or expansion of gases. The machine comprises a housing defining a cavity and having an inlet port and an outlet port, a pair of mating gears rotatably accommodated in the housing, each gear having two kinds of teeth which are of different size and have a common pitch circle, and a pair of shafts each rotatably journaled in the housing and each secured to one of the gears. According to the known rotary machine, torque transmitting means are mounted on the shafts externally of the housing for rotating the pair of mating gear, and the torque transmitting means are arranged to maintain the pair of gears out of metallic contact with each other during rotating. This prior art rotary machine has a relatively large size and a complex structure because of the additional torque transmitting means. In addition, since the gears are out of metallic contact with each other during rotating, and especially each of teeth of larger size is of a configuration with a circular pitch as a unit for engagement (one tooth for one gullet), a large quantity of reflux occurs during the liquid transmission and the efficiency of the transmission becomes very low. Therefore said rotary machine basically does not have the function of gas compression and expansion, and is difficult to be applied in industry.

SUMMARY OF THE INVENTION

An object of the present invention is to provide a compound teeth type gas compressor with less noise, small size, simple configuration and reduced or avoidable gas charging caused by gas reflux.

This object is achieved by a compound teeth type gas compressor according to the present invention, which comprises a housing with an upper end cover and a lower end cover mounted on both sides of the housing for constituting a seal cavity, a pair of meshing gears rotatably accommodated in the cavity, each gear having two kinds of teeth which are of different size and have a common pitch circle, an inlet port and an outlet port, an intake chamber and a discharge chamber positioned respectively on the sides of the inlet port and the outlet port in the cavity, wherein the gears are unidirectionally rotated, one of them is a driving gear having larger teeth, the other is a driven gear having larger gullets engaged with the larger teeth, the larger teeth and the larger gullets are formed with asymmetric shapes, and, as viewed in the rotation directions of the gears, their front flank profile curves are designed to achieve a transmission of a constant angular velocity ratio while their rear flank profile curves are designed to be in conjugate contact with each other from the beginning to the end of touching.

According to a further development of the present invention, the outlet port is arranged in said end cover and a clearance gas discharging groove is arranged on the gear having the larger gullets for connecting the larger gullets with the outlet port.

The compound teeth type gas compressor according to the present invention has the following advantages:

1. The transmitting mechanism and the gas compressing mechanism thereof are unified with a very simple structure. The whole compressor has only five major components: a pair of meshing gears, a housing, an upper end cover and a lower end cover, and thus has a light weight, a small size and a low cost.

2. The dynamic balancing performance thereof is good. The compressor has not any crank or eccentric mechanism, and has a stable movement and a small vibration. No inlet and outlet valves exist, and the compressor has a low noise.

3. The asymmetric arrangement of the flank profiles and the disposition of the clearance gas discharging groove can achieve a small clearance volume, avoid the gas charging caused by gas reflux, and reduce mechanical wear, thereby increasing the energy efficiency ratio and the volumetric efficiency.

BRIEF DESCRIPTION OF THE DRAWINGS

The present invention will be better understood from the following detailed description of some preferred embodiments with reference to the accompanying drawings, in which.

DESCRIPTION OF THE PREFERRED EMBODIMENTS

Figure 1:
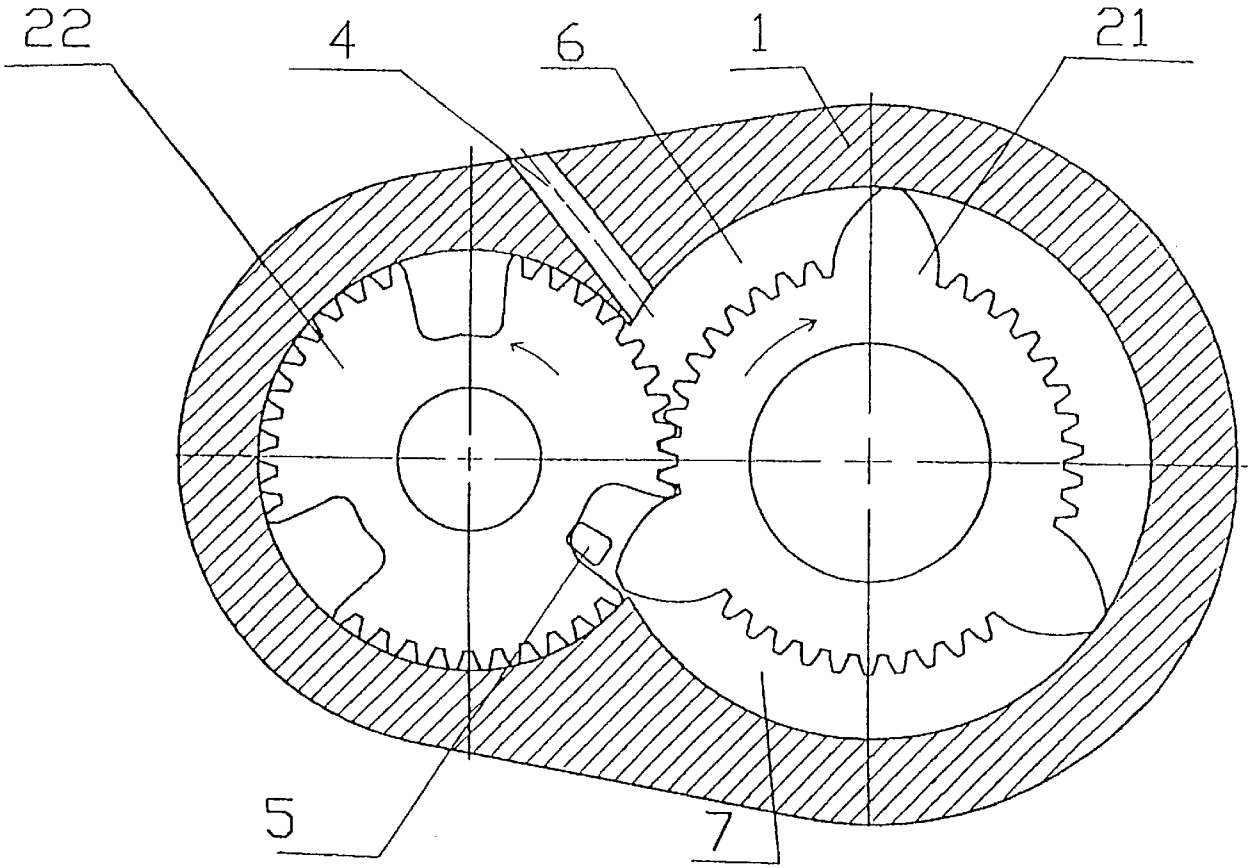
FIG. 1 shows an instantaneous rotation state of a compound teeth type mechanism with a symmetric design for its larger teeth and larger gullets.
Figure 2:
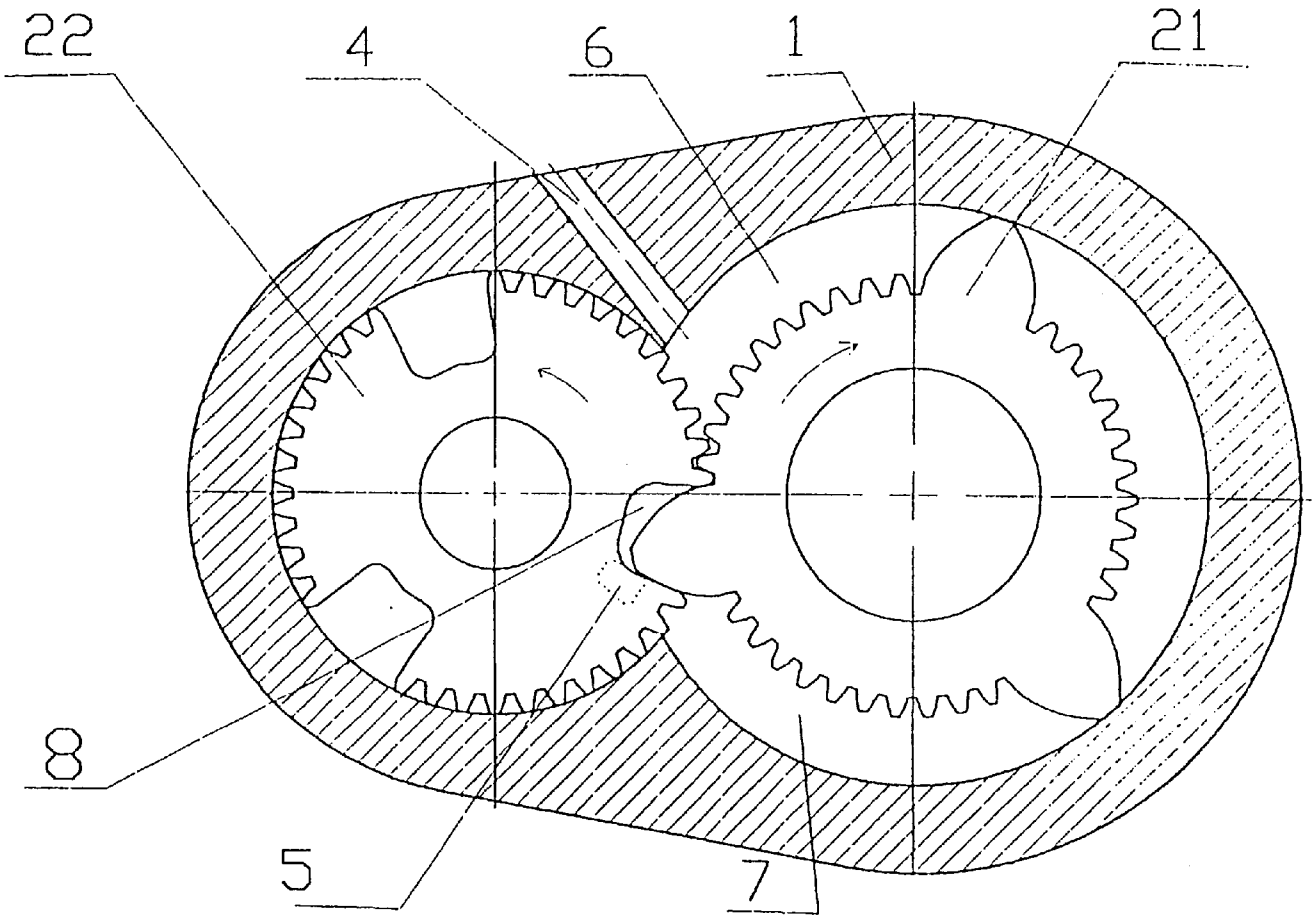
FIG. 2 shows another instantaneous rotation state of the compound teeth type mechanism of FIG. 1.

FIGS. 1 and 2 show a compound teeth type mechanism used in a gas compressor. The mechanism is accommodated in a seal space formed by a housing 1 and end covers 2 and 3 mounted on both sides of the housing 1. The mechanism comprises a driving gear 21 and a driven gear 22 meshed with the driving gear 21. The driving gear 21 and the driven gear 22 each have two kinds of teeth with a common pitch circle. As shown in FIGS. 1 and 2, an intake chamber 6 and a discharge chamber 7 are formed between the housing 1 and the gears. The gas compressor has an inlet port 4 and an outlet port 5, and more particularly, the outlet port 5 is arranged in the end cover 2. It should be noted that the driving gear 21 has complete larger teeth, while the driven gear 22 has larger gullets corresponding to said larger teeth. The larger teeth of the driving gear 21 and the larger gullets of the driven gear 22 are of a symmetric shape. When the compound teeth type mechanism is rotated into the position as shown in FIG. 1, a gap appears over the larger tooth back, thereby causing a portion of high-pressure gas already discharged in the larger gullet to reflow along the larger tooth back into the discharge chamber 7. When the compound teeth type mechanism is rotated into the position of FIG. 2, the high-pressure gas remaining in the larger gullet clearance 8 cannot enter the outlet port 5, and flows finally into the intake chamber 6, resulting in a loss of energy, influencing the intake gas amount and even generating noise.

Figure 3:
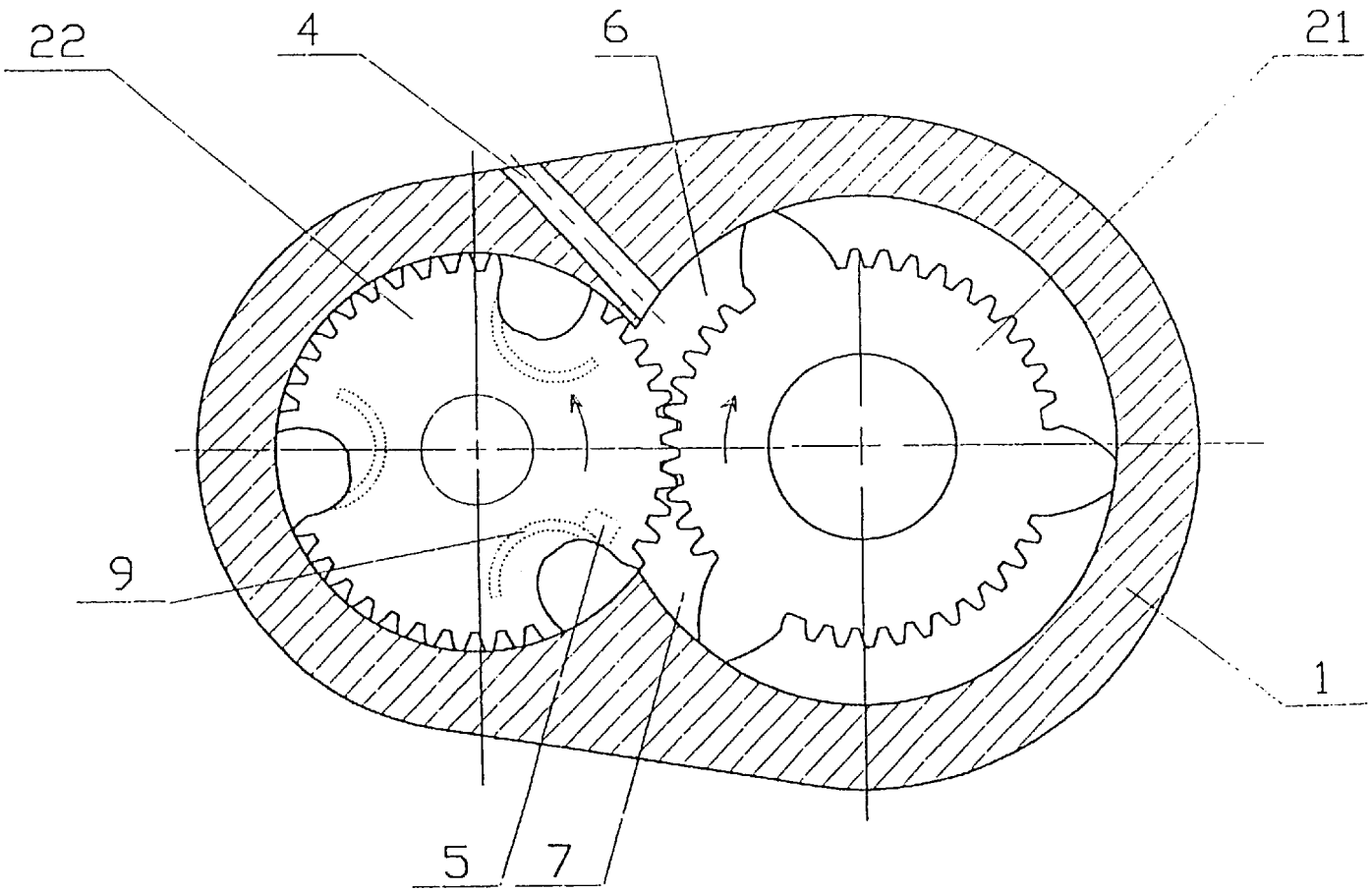
FIG. 3 shows a first instantaneous rotation state of a compound teeth type mechanism with an asymmetric design for its larger teeth and larger gullets.
Figure 4:
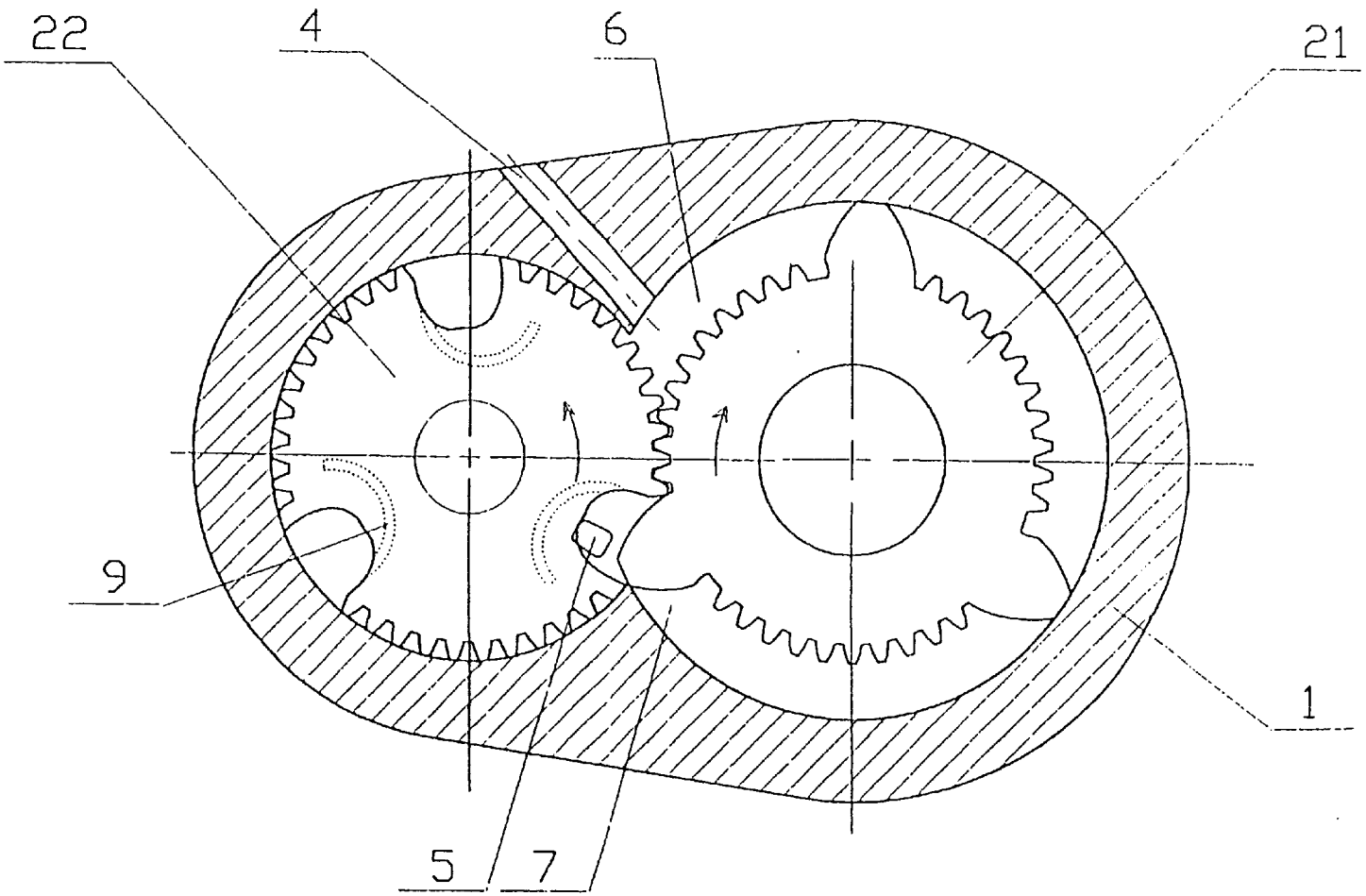
FIG. 4 shows a second instantaneous rotation state of the compound teeth type mechanism of FIG. 3.
Figure 5:
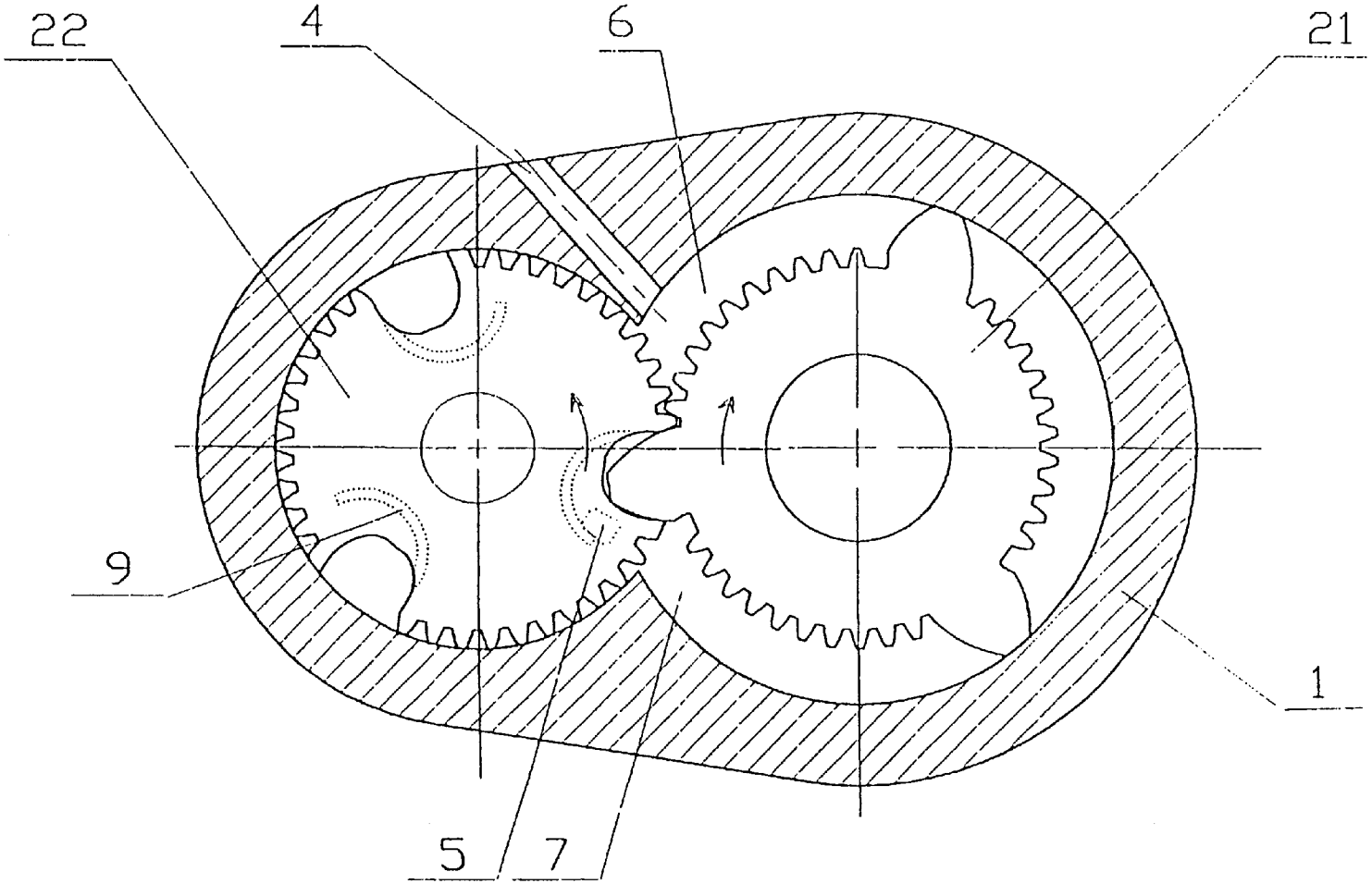
FIG. 5 shows a third instantaneous rotation state of the compound teeth type mechanism of FIG. 3.

FIGS. 3–5 show the first, second and third instantaneous rotation states of a compound teeth type mechanism with an asymmetric design for its larger teeth and larger gullets respectively. In the state shown in FIG. 3, the high-pressure gas in the discharge chamber 7 is just beginning to get in connection with the larger gullet, while the larger gullet is connected with the outlet port 5 and the high-pressure gas is beginning to be discharged from the outlet port 5. When the compound teeth type mechanism continues to rotate into the state of FIG. 4, the high-pressure gas is forced into the larger gullet and continues to be discharged, while the back of the larger tooth begin to get in contact with the larger gullet flank profile and the next process of gas compression begins. At this moment, the engagement of the larger tooth back with the larger gullet flank profile can prevent the gas charging caused by high-pressure gas reflux. When the compound teeth type mechanism continues to rotate into the state of FIG. 5, the larger gullet will lose its direct connection with the outlet port 5. In order to prevent the high-pressure gas in a clearance 8 from returning to the low-pressure intake chamber 6, a clearance gas discharging groove 9 is formed on the gear surface for connecting the clearance 8 with the outlet port 5, and enabling the high-pressure gas in the clearance 8 to be discharged through the clearance gas discharging groove 9 into the outlet port 5.

Figure 6:
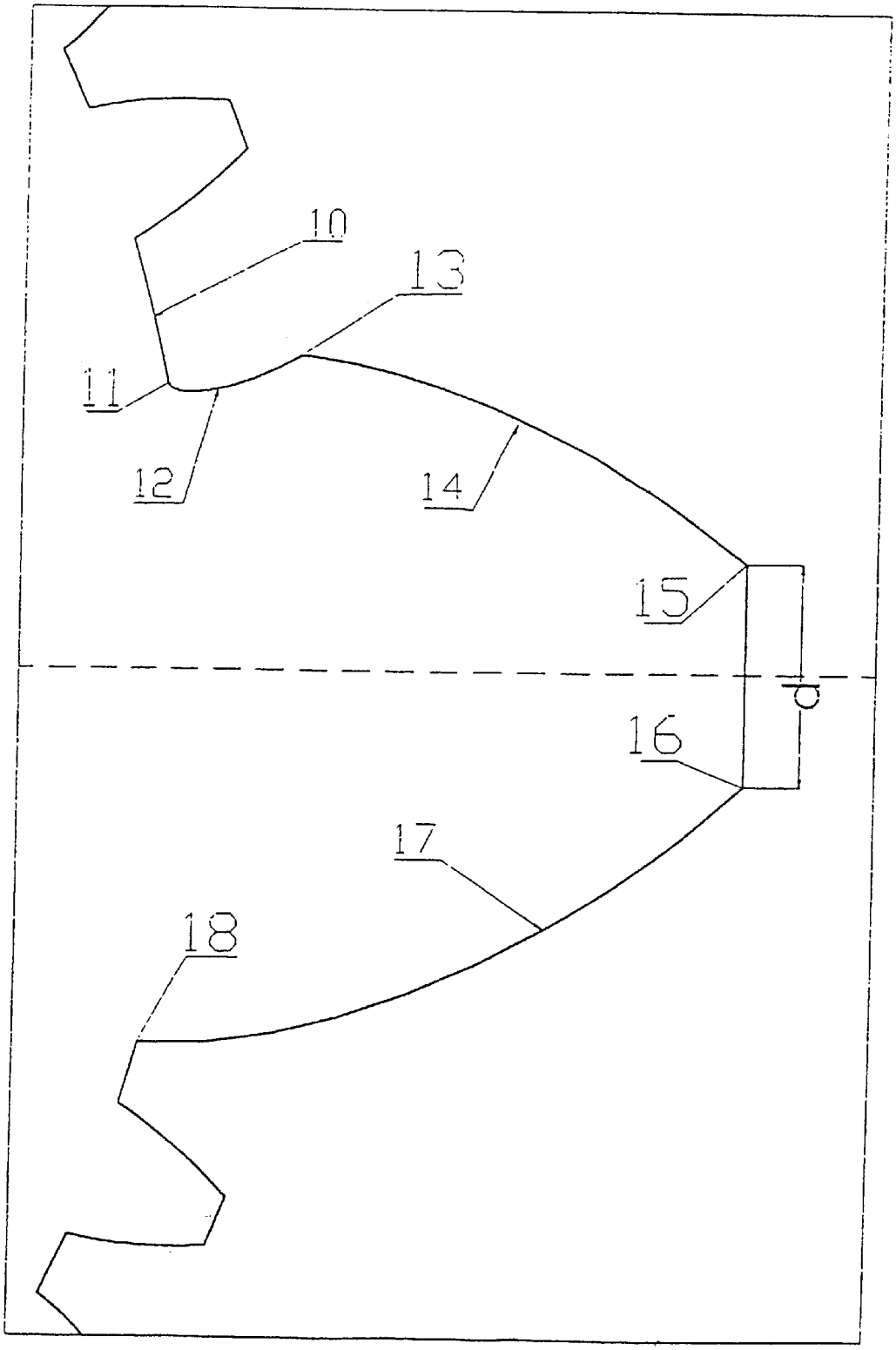
FIG. 6 shows the flank profiles of a larger tooth according to the present invention.
Figure 7:
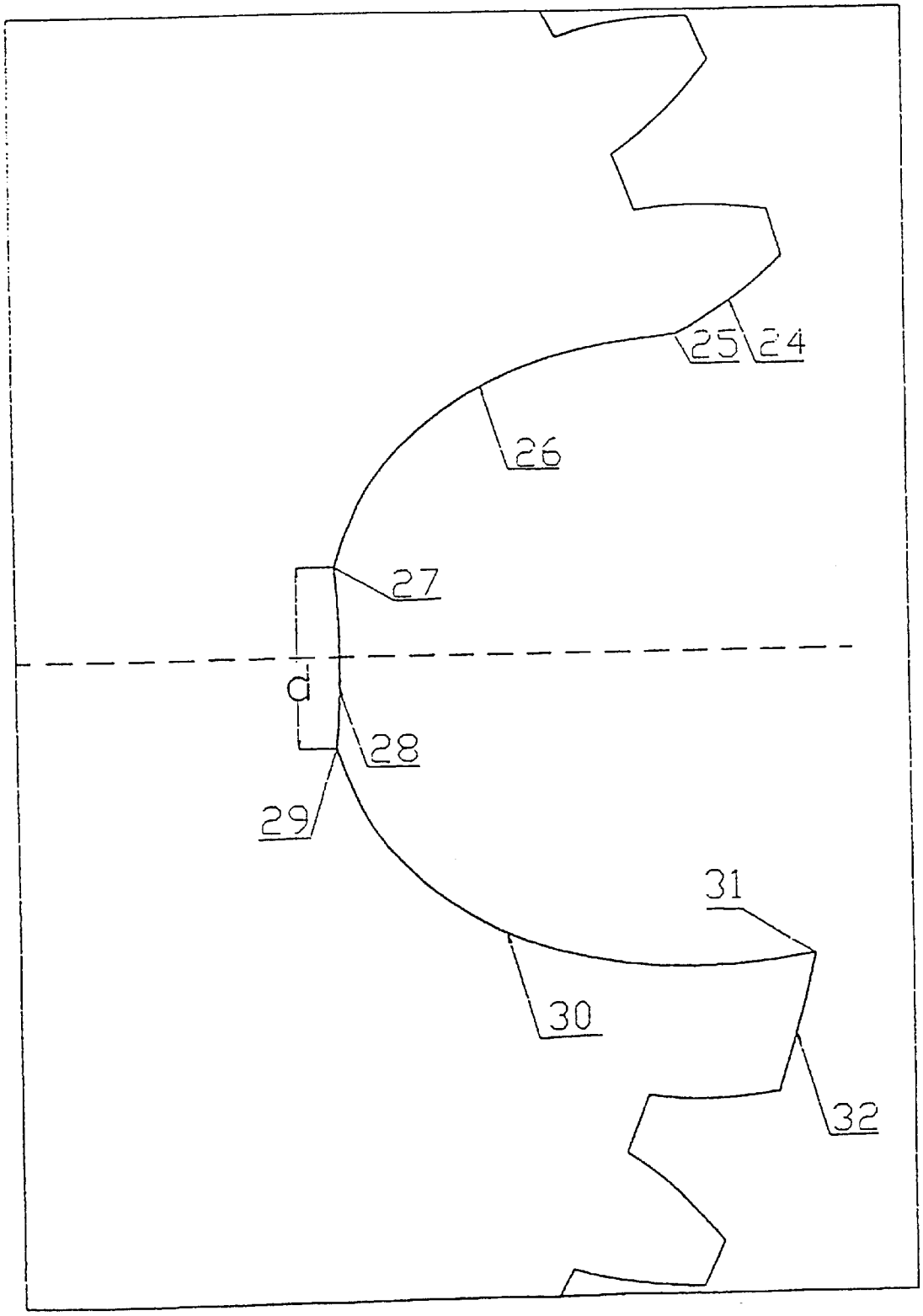
FIG. 7 shows an example of the flank profiles of a larger gullet corresponding to the larger tooth of FIG. 6.

FIGS. 6 and 7 show the flank profile curves of a larger tooth and a larger gullet respectively. It can be seen from FIGS. 6 and 7 that the flank profile curves of the larger tooth and the larger gullet are designed to be asymmetric. An object of such design is to prevent a high-pressure gas charging caused by the gas reflux and to make the clearance volume as small as possible. In consideration of the fact that each of the gears in the compressor rotates in one direction, profile curves 17 and 24 in FIGS. 6 and 7 are designed as an involute or a cycloid to realize a gear transmission of a constant angular speed ratio. After the curve 17 has separated from the curve 24 and at the moment when the follow-up smaller teeth have not engaged, the rotation is realized by the curve 17 and the curve 26. According to the gear engagement theory and in considering the possibility of a computer-aided design and analysis based on an analytical method as well as the convenience of gear fabrication, the curve 26 is realized as a cycloid. The curves 14 and 30 also are realized as cycloids. To ensure a sealing state and to avoid any high-pressure gas reflux, there should be a continuous point contact between two. profile curves from a point 15 to a point 13. A point 31 begins to contact the point 15 as soon as the larger tooth leaves the discharge chamber 7. The addendum width d of the larger tooth is equal to the bottom width d of the larger gullet. A curve 12 is designed as a transition one defined by the motion locus of the point 31 and has a smooth transition with a smaller tooth root circle (at a point 11). A small circular arc is used for a smooth transition between the point 13 and a point 25.

Figure 8:
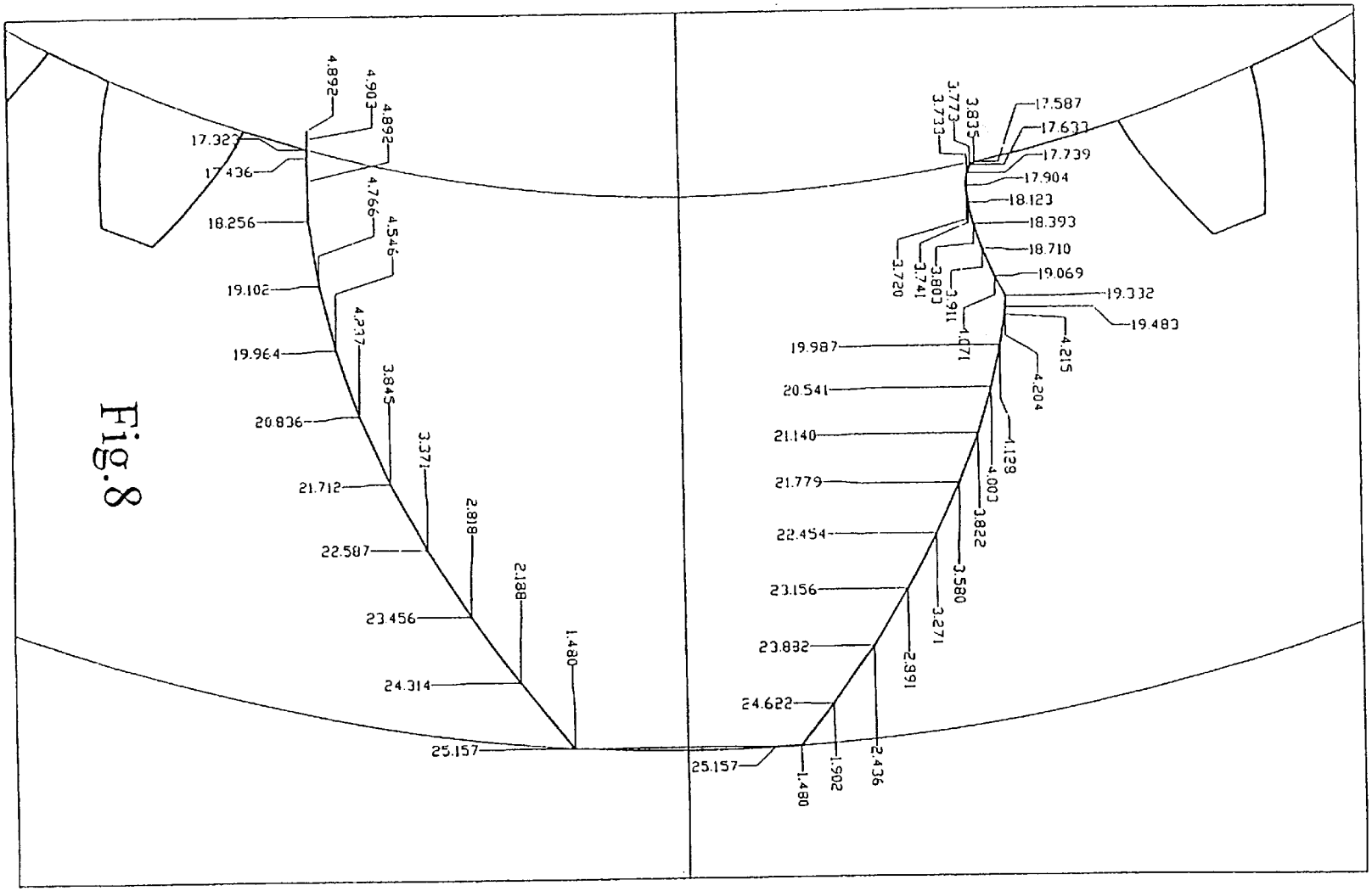
FIG. 8 shows an example of a flank profile curve of a larger tooth.
Figure 9:
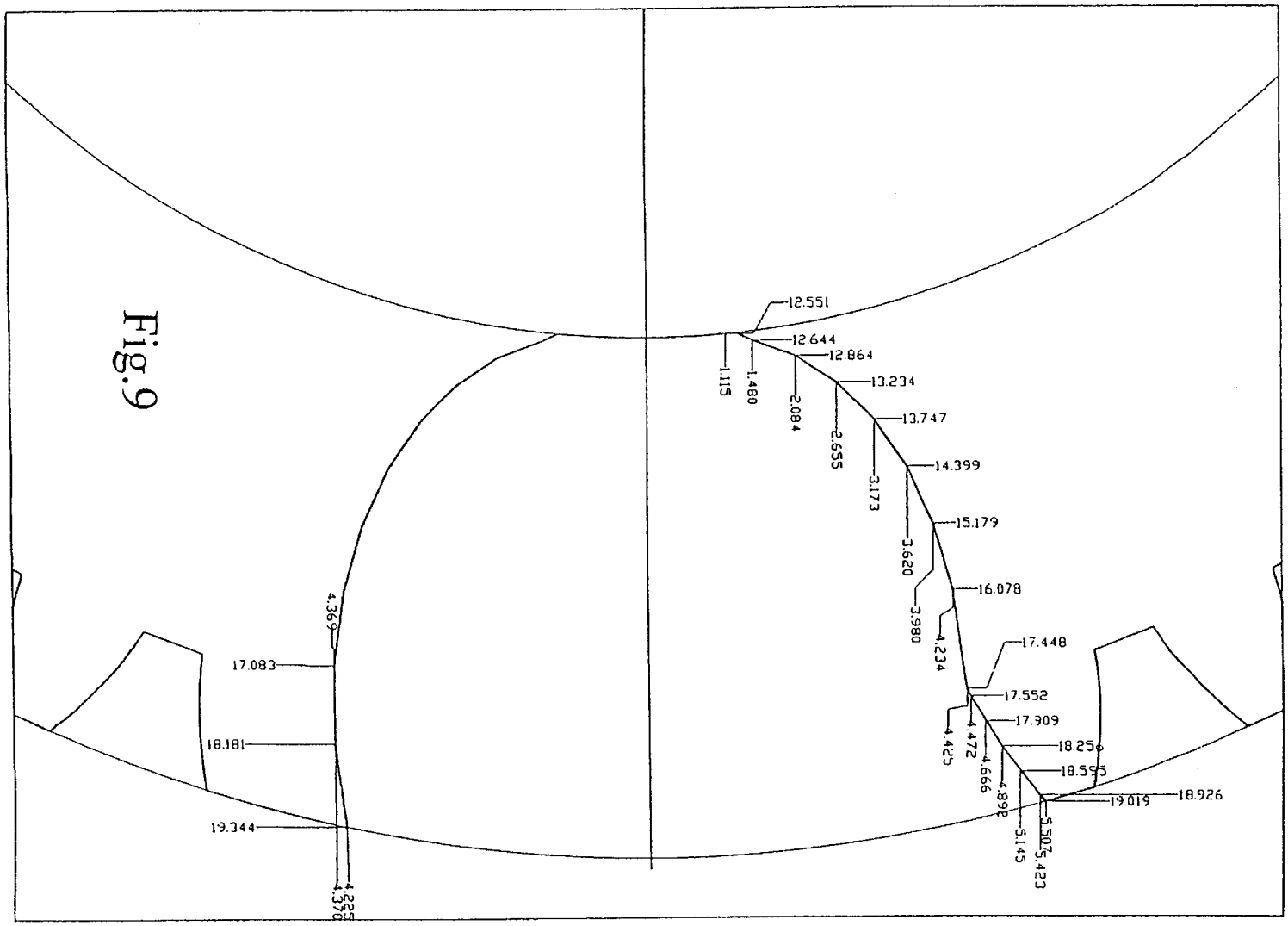
FIG. 9 shows an example of a flank profile curve of a larger gullet corresponding to the larger tooth of FIG. 8.

A pair of examples of the flank profile curves of the larger tooth and the larger gullet are shown in FIGS. 8 and 9, in which the data at each point are the coordinate values of the point.

Figure 10:
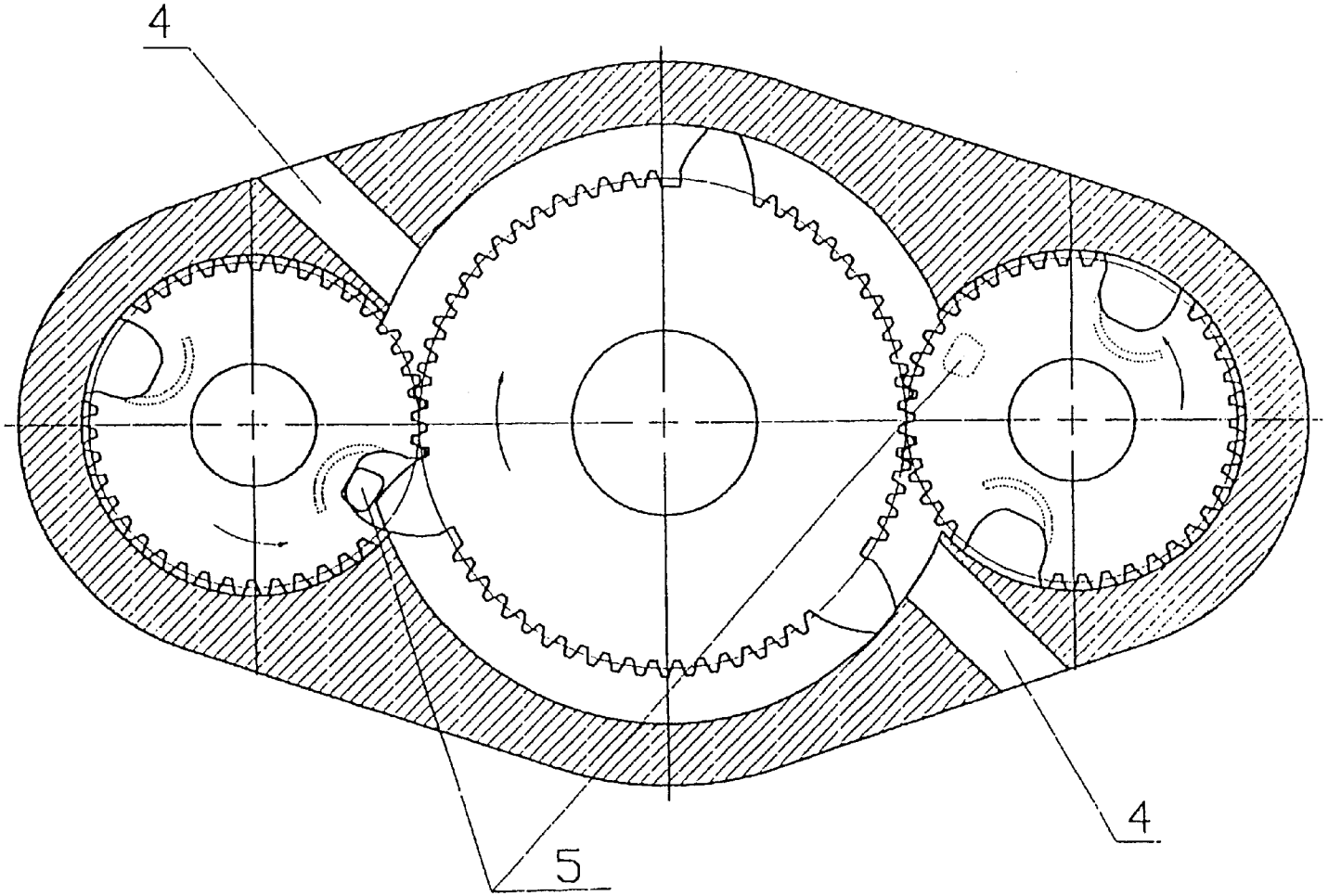
FIG. 10 is a schematic diagram of another design of a compound teeth type mechanism according to the present invention.

FIG. 10 is a schematic diagram of a gas compressor with two driven gears. It is seen from FIG. 10 that the gas compressor has two inlet ports 4 and two outlet ports 5. Compared with a gas compressor with only one driven gear, the delivery capacity of the present gas compressor is doubled.

Figure 11:
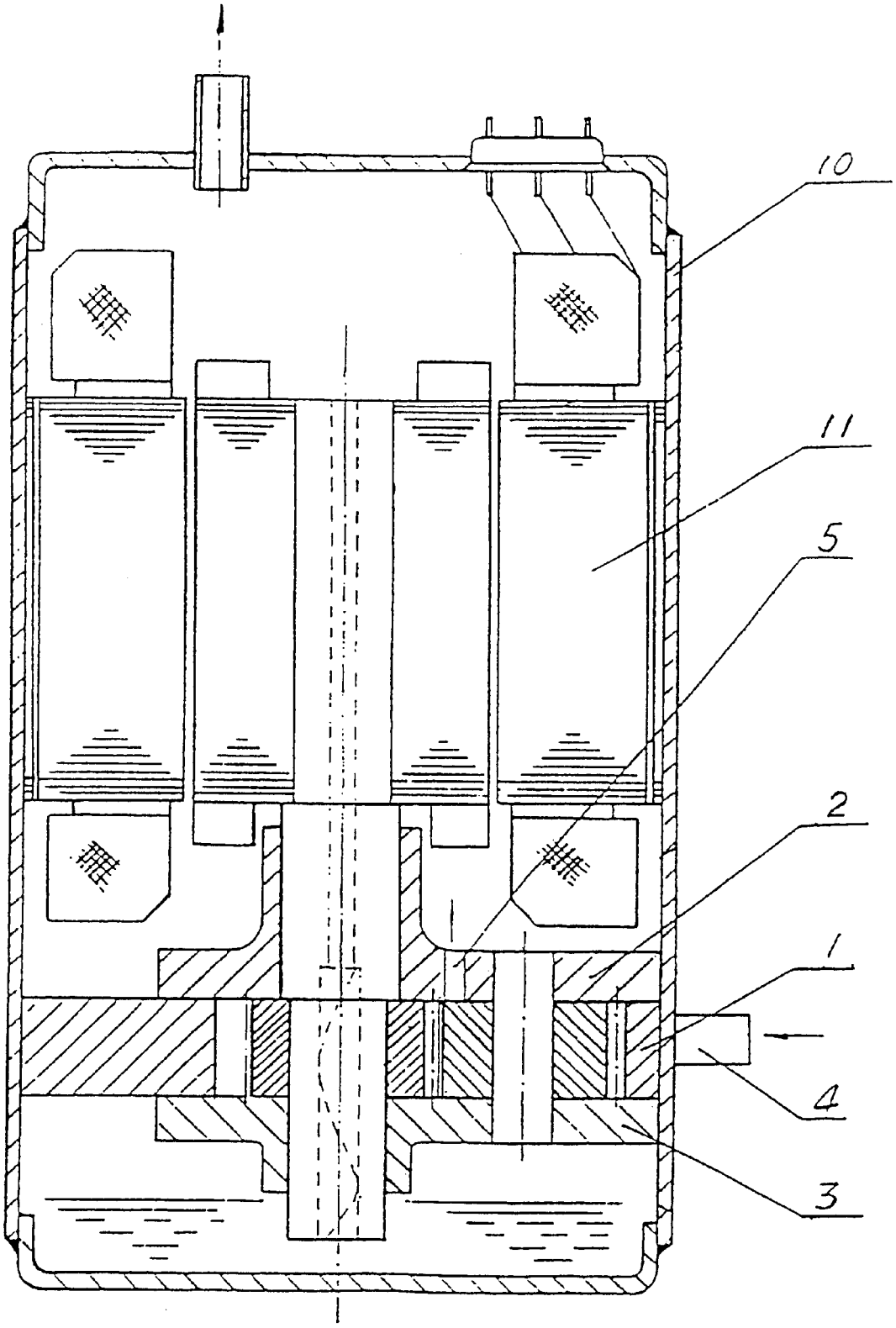
FIG. 11 is a schematic diagram showing the structure of an air conditioning compressor using a compound teeth type mechanism according to the present invention.

FIG. 11 is a schematic diagram of a gas compressor having the compound teeth type mechanism of the present invention. In FIG. 11, a motor 11 and a compressor are accommodated in a sealed housing 10, and the compressor is located below the motor 11. The compressor has an inlet port 4 in the housing 1 thereof and an outlet port 5 in an upper end cover 2. The housing 1, the upper end cover 2 and a lower end cover 3 define a seal space, in which a compound teeth type mechanism constituted by a driving gear and a driven gear is accommodated. With reference to FIG. 3, it is evident that the volume of the intake chamber 6 increases gradually as the motor brings the driving gear into rotation, and a partial negative pressure is thus created, thereby causing the gas to be drawn into the intake chamber 6 through the inlet port 4. With the rotation of the gear, the gas is brought into the discharge chamber 7, and the volume of the discharge chamber 7 is reduced gradually, thereby causing the gas to be compressed. When the gear is rotated into the position where the discharge chamber 7 is connected directly with the outlet port 5, the gas is then discharged. With the continuous engagement rotation of the gears, the gas in the clearance 8 is finally discharged through the clearance gas discharging groove 9 into the outlet port 5 in the upper end cover 2, thus realizing a basic operational process of a gas compressor: gas suction, delivery, compression and gas discharge. The discharged gas of the compressor is concentrated in an upper cavity of the housing 10 and is finally discharged into an operational loop.

What is claimed is:

1. A compound teeth type gas compressor, comprising a housing with an upper end cover and a lower end cover mounted on both sides of the housing for constituting a seal cavity, a pair of meshing gears rotatably accommodated in the cavity, each gear having two kinds of teeth which are of different size and have a common pitch circle, an inlet port and an outlet port, an intake chamber and a discharge chamber positioned respectively on the sides of the inlet port and the outlet port in the cavity, characterized in fact that the gears are unidirectionally rotated, one of them is a driving gear having larger teeth, the other is a driven gear having larger gullets engaged with the larger teeth, the larger teeth and the larger gullets are formed with asymmetric shapes, and, as viewed in the rotation directions of the gears, their front flank profile curves are designed to achieve a transmission of a constant angular velocity ratio while their rear flank profile curves are designed to be in conjugate contact with each other from the beginning to the end of touching.

2. A compound teeth type gas compressor according to claim 1, characterized in that said outlet port is provided in at least one end cover, and a clearance gas discharging groove is provided on the surface of the driven gear for connecting the larger gullet with the outlet port.

3. A compound teeth type gas compressor according to claim 1, characterized in that the compressor further comprises at least one other driven gear meshed with said driving gear, and an inlet port and an outlet port are arranged for each driven gear.

* * * * *